US010781569B2

(12) United States Patent
Thomas et al.

(10) Patent No.: US 10,781,569 B2
(45) **Date of Patent: *Sep. 22, 2020**

(54) CONFINEMENT STRUCTURES—DEFENCELL PLASTIC GABION SYSTEM

(71) Applicant: Fiberweb Holdings Limited, London (GB)

(72) Inventors: Basil John Thomas, Gwent (GB); William W. Walmsley, Bolton (GB)

(73) Assignee: Fiberweb Holdings Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 16/289,987

(22) Filed: Mar. 1, 2019

(65) Prior Publication Data

US 2019/0194899 A1 Jun. 27, 2019

Related U.S. Application Data

(63) Continuation of application No. 14/233,993, filed as application No. PCT/GB2012/051750 on Jul. 20, 2012, now Pat. No. 10,267,010.

(30) Foreign Application Priority Data

Jul. 21, 2011 (GB) ..... 1112549.9

(51) Int. Cl.

| | |
|---|---|
| ***E02D 29/02*** | (2006.01) |
| ***E04C 1/00*** | (2006.01) |
| ***E04H 9/04*** | (2006.01) |

(52) U.S. Cl.

CPC ..... *E02D 29/0208* (2013.01); *E02D 29/0241* (2013.01); *E04C 1/00* (2013.01); *E04H 9/04* (2013.01)

(58) Field of Classification Search

CPC ... E02D 29/0208; E02D 29/0241; E04C 1/00; E04H 9/04

See application file for complete search history.

(56) References Cited

U.S. PATENT DOCUMENTS

| | | | |
|---|---|---|---|
| 1,412,742 | A | 4/1922 | Herbermann |
| 2,455,237 | A | 11/1948 | Davis |

(Continued)

FOREIGN PATENT DOCUMENTS

| | | | |
|---|---|---|---|
| CN | 2683703 | Y | 3/2005 |
| CN | 2703793 | Y | 6/2005 |

(Continued)

OTHER PUBLICATIONS

International Search Report and Written Opinion dated Aug. 1, 2013, in International Patent Application No. PCT/GB2012/051750 (published as WO 2013/050732).

(Continued)

*Primary Examiner* — Benjamin F Fiorello
(74) *Attorney, Agent, or Firm* — Burr & Forman LLP

(57) ABSTRACT

A confinement structure comprises one or more open cells (70) for confinement, in use, of particulate fill materials such as soil, sand or aggregate. The cells (70) comprise walls (72) formed of a composite material comprising a polymeric grid layer laminated to a fabric layer. The walls (72) may be formed from a strip of the composite material comprising one or more living hinges. The cells (70) may be provided with skirt portions (74) that extend from at least some of the walls (72).

16 Claims, 4 Drawing Sheets

(56) References Cited

U.S. PATENT DOCUMENTS

| | | | | |
|---|---|---|---|---|
| 3,645,961 | A | 2/1972 | Goldfein | |
| 3,974,789 | A | 8/1976 | DeGroot | |
| 4,011,728 | A | 3/1977 | Turzillo | |
| 4,086,015 | A | 4/1978 | Eliasson | |
| 4,184,788 | A | 1/1980 | Colle | |
| 4,198,454 | A | 4/1980 | Norton | |
| 4,477,206 | A | 10/1984 | Papetti et al. | |
| 4,530,622 | A | 7/1985 | Mercer | |
| 4,572,705 | A | 2/1986 | Vignon et al. | |
| 4,591,090 | A | 5/1986 | Collins et al. | |
| 4,630,395 | A | 12/1986 | Nasatka | |
| 4,643,271 | A | 2/1987 | Coburn | |
| 4,655,637 | A | 4/1987 | Vignocchi | |
| 4,717,283 | A | 1/1988 | Bach | |
| 4,722,954 | A | 2/1988 | Hallworth | |
| 4,726,708 | A | 2/1988 | Papetti | |
| 4,778,309 | A | 10/1988 | Bach et al. | |
| 4,785,604 | A | 11/1988 | Johnson, Jr. | |
| 4,797,026 | A | 1/1989 | Webster | |
| 4,822,657 | A | 4/1989 | Simpson | |
| 4,854,767 | A | 8/1989 | Sasaki | |
| 4,879,154 | A | 11/1989 | Bennett | |
| 4,904,121 | A | 2/1990 | Hallberg | |
| 4,945,689 | A | 8/1990 | Johnson, Jr. | |
| 5,039,250 | A | 8/1991 | Janz | |
| 5,041,250 | A | 8/1991 | Neefe | |
| 5,161,917 | A | 11/1992 | Papetti | |
| 5,199,825 | A | 4/1993 | Travis | |
| 5,225,622 | A | 7/1993 | Gettle et al. | |
| 5,270,095 | A | 12/1993 | Ito et al. | |
| 5,277,520 | A | 1/1994 | Travis | |
| 5,333,970 | A | 8/1994 | Heselden | |
| 5,472,297 | A | 12/1995 | Heselden | |
| 5,501,758 | A | 3/1996 | Nitardy | |
| 5,534,343 | A | 7/1996 | Landi et al. | |
| 5,549,410 | A | 8/1996 | Beryozkin et al. | |
| 5,636,938 | A | 6/1997 | Ragazzo | |
| 5,647,695 | A | 7/1997 | Hilfiker et al. | |
| 5,677,016 | A | 10/1997 | Ferraiolo | |
| 5,678,358 | A | 10/1997 | Koledin | |
| 5,684,264 | A | 11/1997 | Cassells et al. | |
| 5,830,548 | A | 11/1998 | Andersen et al. | |
| 5,860,551 | A | 1/1999 | Knott, Sr. | |
| 5,918,309 | A | 7/1999 | Bachner, Jr. | |
| 5,927,906 | A | 7/1999 | Bach et al. | |
| 5,939,658 | A | 8/1999 | Muller | |
| 5,965,467 | A * | 10/1999 | Stevenson | D03D 9/00 405/129.75 |
| 6,149,998 | A * | 11/2000 | Hettinga | E05D 1/02 156/308.4 |
| 6,409,420 | B1 | 6/2002 | Horton et al. | |
| 6,484,473 | B1 | 11/2002 | Hall | |
| 6,517,279 | B1 | 2/2003 | Camomilla et al. | |
| 6,544,624 | B1 | 4/2003 | Lopez-Anido et al. | |
| 6,581,505 | B1 | 6/2003 | Levell | |
| 6,666,124 | B2 | 12/2003 | Fleming | |
| 6,749,076 | B2 | 6/2004 | Fingerhut et al. | |
| 6,786,126 | B2 | 9/2004 | Sargent | |
| 6,807,890 | B1 | 10/2004 | Fuqua | |
| 6,817,806 | B1 | 11/2004 | Arellanes | |
| 6,893,193 | B2 | 5/2005 | Santha | |
| 6,907,811 | B2 | 6/2005 | White | |
| 7,117,644 | B2 | 10/2006 | Dehart | |
| 7,159,503 | B1 | 1/2007 | Weatherwax | |
| 7,214,005 | B1 | 5/2007 | Davis | |
| 7,249,912 | B2 | 7/2007 | Reese | |
| 7,357,602 | B2 | 4/2008 | Ferraiolo | |
| 7,425,107 | B2 | 9/2008 | Derache | |
| 7,431,534 | B2 | 10/2008 | Harbeck | |
| 7,591,611 | B2 | 9/2009 | Arellanes et al. | |
| 7,678,440 | B1 | 3/2010 | McKnight et al. | |
| 7,765,744 | B2 | 8/2010 | Herron | |
| 8,790,036 | B2 | 7/2014 | Halahmi et al. | |
| 2001/0002968 | A1 | 6/2001 | Black | |
| 2001/0002986 | A1 | 6/2001 | Fattinger et al. | |
| 2002/0127384 | A1 | 9/2002 | Mulligan et al. | |
| 2003/0035690 | A1 | 2/2003 | Earl | |
| 2003/0095834 | A1 | 5/2003 | Witcher | |
| 2003/0221256 | A1 | 12/2003 | Monk et al. | |
| 2004/0118271 | A1 | 6/2004 | Puckett et al. | |
| 2004/0151404 | A1 | 8/2004 | Richardson et al. | |
| 2004/0251698 | A1 | 12/2004 | Welch et al. | |
| 2005/0117978 | A1 | 6/2005 | Loffel | |
| 2005/0123355 | A1 | 6/2005 | Kolenski et al. | |
| 2005/0170720 | A1 | 8/2005 | Christiansen et al. | |
| 2005/0217471 | A1 | 10/2005 | Benitsch | |
| 2005/0229771 | A1 | 10/2005 | Lewis | |
| 2005/0262794 | A1 | 12/2005 | Derache | |
| 2006/0048640 | A1 | 3/2006 | Terry et al. | |
| 2006/0062944 | A1 | 3/2006 | Gardner et al. | |
| 2006/0147275 | A1 | 7/2006 | Lin et al. | |
| 2006/0147276 | A1 | 7/2006 | Lin et al. | |
| 2006/0248827 | A1 | 11/2006 | Meeker | |
| 2006/0275084 | A1 | 12/2006 | Harbeck | |
| 2006/0291962 | A1 | 12/2006 | Ferraiolo | |
| 2007/0000377 | A1 | 1/2007 | Ohnstad | |
| 2007/0031667 | A1 | 2/2007 | Hook et al. | |
| 2007/0140598 | A1 | 6/2007 | McGillick et al. | |
| 2007/0245933 | A1 | 10/2007 | Kramer et al. | |
| 2007/0293107 | A1 | 12/2007 | Folio et al. | |
| 2008/0023156 | A1 | 1/2008 | MacAllen et al. | |
| 2008/0038064 | A1 | 2/2008 | Arrellaners et al. | |
| 2008/0131212 | A1 | 6/2008 | Quinley et al. | |
| 2008/0145599 | A1 | 6/2008 | Khan et al. | |
| 2008/0264546 | A1 | 10/2008 | Olsta et al. | |
| 2008/0290141 | A1 | 11/2008 | Shaw et al. | |
| 2008/0292854 | A1 | 11/2008 | Miller et al. | |
| 2009/0142144 | A1 | 6/2009 | Erez et al. | |
| 2009/0169311 | A1 | 7/2009 | Sharley et al. | |
| 2009/0230373 | A1 | 9/2009 | Helseden | |
| 2009/0235507 | A1 | 9/2009 | Cashin et al. | |
| 2009/0235813 | A1 | 9/2009 | Cashin et al. | |
| 2009/0235814 | A1 | 9/2009 | Cashin et al. | |
| 2009/0250675 | A1 | 10/2009 | Cashin et al. | |
| 2009/0324346 | A1 | 12/2009 | Milton et al. | |
| 2010/0024343 | A1 | 2/2010 | Eggermont | |
| 2010/0043630 | A1 | 2/2010 | Sayre et al. | |
| 2010/0072101 | A1 | 3/2010 | Heselden | |
| 2010/0080941 | A1 | 4/2010 | McCarville et al. | |
| 2010/0095588 | A1 | 4/2010 | Hashimoto | |
| 2010/0143049 | A1 | 6/2010 | Heselden | |
| 2011/0033654 | A1 | 2/2011 | Walmsley et al. | |
| 2012/0137598 | A1 | 6/2012 | Chamoux | |

FOREIGN PATENT DOCUMENTS

| | | | |
|---|---|---|---|
| CN | 201310092 | Y | 9/2009 |
| DE | 10025125 | A1 | 11/2001 |
| EP | 0106745 | A2 | 4/1984 |
| EP | 0136747 | B1 | 4/1985 |
| EP | 0378309 | A1 | 7/1990 |
| EP | 0378310 | A1 | 7/1990 |
| EP | 0735198 | A1 | 10/1996 |
| EP | 0285378 | A1 | 10/1998 |
| EP | 1308562 | A1 | 5/2003 |
| EP | 1418276 | A2 | 5/2004 |
| FR | 2699948 | B1 | 7/1994 |
| FR | 2716688 | A1 | 9/1995 |
| FR | 2824340 | A1 | 11/2002 |
| GB | 974066 | A | 7/1962 |
| GB | 1208205 | A | 10/1970 |
| GB | 2029802 | B | 3/1980 |
| GB | 2078833 | B | 1/1982 |
| GB | 2314802 | A | 1/1998 |
| GB | 2432611 | A | 5/2007 |
| GB | 2440147 | A | 1/2008 |
| GB | 2485212 | A | 5/2012 |
| JP | 58106020 | A | 6/1983 |
| JP | 58189425 | A | 11/1983 |
| JP | 07213159 | | 8/1995 |
| KR | 1020040111216 | A | 12/2004 |
| WO | 9012160 | A1 | 10/1990 |
| WO | 9319250 | A1 | 9/1993 |
| WO | 9727368 | A1 | 7/1997 |

(56) References Cited

FOREIGN PATENT DOCUMENTS

| | | | |
|---|---|---|---|
| WO | 9815693 | A1 | 4/1998 |
| WO | 9957200 | A1 | 11/1999 |
| WO | 9963166 | A1 | 12/1999 |
| WO | 03038196 | A1 | 5/2003 |
| WO | 04079094 | A2 | 9/2004 |
| WO | 05080691 | A1 | 9/2005 |
| WO | 06134136 | A1 | 12/2006 |
| WO | 2008037972 | A1 | 4/2008 |
| WO | 2009019500 | A1 | 2/2009 |
| WO | 2010007279 | A1 | 1/2010 |
| WO | 2010103128 | A1 | 9/2010 |

OTHER PUBLICATIONS

International Preliminary Report on Patentability dated Jan. 21, 2014, in International Patent Application No. PCT/GB2012/051750 (published as WO 2013/050732).
Third Party Observations submitted Nov. 21, 2013, in International Patent Application No. PCT/GB2012/051750 published as WO 2013/050732).
Examination Report under Section 18(3) of corresponding Great Britain Application No. 1112549.9, dated May 4, 2016, all enclosed pages cited.
Examination Report under Section 18(3) of corresponding United Kingdom Application No. GB1112549.9, dated Dec. 16, 2016, all enclosed pages cited.
Examination Report under Section 18(3) of corresponding United Kingdom Application No. GB1112549.9, dated May 5, 2017, all enclosed pages cited.
Notification of Patent Grant of corresponding United Kingdom Application No. GB1112549.9, dated Aug. 1, 2017, all enclosed pages cited.
U.S. Appl. No. 12/188,295, and its prosecution history.
U.S. Appl. No. 12/188,329, and its prosecution history.
U.S. Appl. No. 12/409,600, and its prosecution history.
U.S. Appl. No. 12/442,756, and its prosecution history.
U.S. Appl. No. 12/879,124, and its prosecution history.
U.S. Appl. No. 12/863,827, and its prosecution history.
European Search Report for EP 10188494.8, dated May 31, 2012.
European Search Report for EP 10188497.1, dated Mar. 3, 2013.
European Search Report for EP 11160518.4 dated Mar. 7, 2013.
Search Report for GB 1112549.9, dated Oct. 26, 2011.
International Search Report and Written Opinion dated Jun. 24, 2009, in International Patent Application No. PCT/GB2009/000673.
International Preliminary Report on Patentability dated Sep. 14, 2010, in International Patent Application No. PCT/GB2009/000673.
International Search Report and Written Opinion dated Nov. 16, 2009, in International Patent Application No. PCT/US2009/037780.
International Preliminary Report on Patentability dated Sep. 28, 2010, in International Patent Application No. PCT/US2009/037780.
International Search Report and Written Opinion dated Dec. 3, 2009, in International Patent Application No. PCT/US2009/037945.
International Preliminary Report on Patentability dated Sep. 28, 2010, in International Patent Application No. PCT/US2009/037945.
International Search Report and Written Opinion dated Nov. 13, 2009, in International Patent Application No. PCT/US2009/037785.
International Preliminary Report on Patentability dated Sep. 28, 2010, in International Patent Application No. PCT/US2009/037785.
International Search Report and Written Opinion dated May 28, 2009, in International Patent Application No. PCT/US2009/038060.
International Preliminary Report on Patentability dated Sep. 28, 2010, in International Patent Application No. PCT/US2009/038060.

* cited by examiner

CONFINEMENT STRUCTURES—DEFENCELL PLASTIC GABION SYSTEM

CROSS-REFERENCE TO RELATED APPLICATIONS

This application is a continuation of U.S. patent application Ser. No. 14/233,993 filed Feb. 21, 2014, which is a national-stage entry of International Application No. PCT/GB2012/051750 filed Jul. 20, 2012, and which claims priority from Application No. GB1112549.9 filed Jul. 21, 2011 and claims the benefit of the its earlier filing date under 35 U.S.C. 119(e); each of U.S. patent application Ser. No. 14/233,993, International Application No. PCT/GB2012/051750, and Application No. GB1112549.9 are incorporated herein by reference in their entirety.

FIELD OF THE DISCLOSURE

The present invention relates to confinement structures for particulate fill materials such as soil, sand or aggregate, in particular to cellular confinement structures that can be filled to form protective and defensive walls, barriers, etc. for civil and military applications.

BACKGROUND

In the field of civil engineering it is known to use gabions to contain aggregate such as stones or rocks to form shoring blocks. These containers are usually made of metal wire or, sometimes, plastic mesh. A three dimensional cellular confinement structure formed from plastics, for example Presto Geoweb®, is known to be used for soil stabilization purposes. For military applications there have been proposed rigid plastic construction blocks that can be rapidly deployed and stacked to form protective barriers, such as Hesco® Blastbloc®. However, units made of metal or plastic materials are often heavy and difficult to transport. In a military application, when subjected to a ballistic attack these units can break into dangerous fragments that cause secondary damage.

Cellular confinement systems utilising a three dimensional geotextile 'honeycomb' structure, such as are available from Fiberweb Geosynthetics Ltd. (formerly Terram Ltd.), are known to provide ground stabilisation across a wide variety of applications. A cellular geotextile confinement system designed for military applications is also sold under the brand DefenCell™ for force protection, blast mitigation and ballistic protection. These systems can confine a range of fill materials within the cells formed of flexible geotextile material. While cellular confinement structures formed of geotextile materials are lightweight and easy to handle, they can be easily damaged and often require a temporary structure or frame to assist with installation.

The present invention seeks to mitigate the problems outlined above and to provide an improved confinement structure for use in both military and civil applications.

SUMMARY OF THE DISCLOSURE

According to a first aspect of the present invention there is provided a confinement structure comprising one or more open cells for confinement, in use, of particulate fill materials such as soil, sand or aggregate, the or each cell comprising one or more walls formed of a composite material, wherein the composite material comprises a polymeric grid layer laminated to a fabric layer.

It will be understood that in a confinement structure according to the invention the cell walls are formed of polymeric and fabric materials rather than metallic mesh or rigid plastic panels. The composite material addresses both the transportation and fragmentation issues of existing cellular containment systems. The polymeric grid layer can be rigid enough to allow the cell(s) of the structure to be filled without requiring additional support but also sufficiently ductile to tolerate ballistic damage and not shatter, thus avoiding fragmentation hazards. Not only can the fabric layer prevent the escape of finer particulate fill materials such as sand that would otherwise pass through the polymeric grid, but several advantages result from laminating the layers together into a composite material. The walls can be assembled from a single integral material without the need to attach a fabric layer after forming the cells from grid material, facilitating faster installation. The composite material ensures that stresses generated by the fill materials will be distributed through each component layer of the wall. The inclusion of the polymeric grid layer in the cell walls imparts considerable benefits in terms of resistance to accidental or malicious damage when compared to a fabric-only construction, or even compared to a system wherein a fabric layer is loosely attached to metal or plastics mesh wall panels. For example, the laminated composite material would be significantly more difficult to cut than separate fabric and mesh layers. The whole structure is able to flat-pack for ease of transportation and can be significantly lighter than an equivalent metal or rigid plastic system.

The confinement structure may comprise a single cell. These single cells may then be stacked side-by-side and/or on top of one another to build larger structures ranging from crash barriers to defensive walls. However, in many applications a multi-cell structure may be preferred. In a preferred set of embodiments the confinement structure therefore comprises a plurality of interconnected open cells. The cells are preferably interconnected by internal walls of the multi-cell structure. In a preferred set of embodiments the structure is formed from single cells with the walls (or wall panels) of two adjacent cells fixed together to form an internal wall of the multi-cell structure. The internal wall may therefore be a double wall. The cells may be fixed together by gluing, stitching, thermal bonding, or any other appropriate fixing technique. Preferably metal fixings are not used, to avoid secondary damage in ballistics defence, but in some less preferred embodiments conventional fixings such as rivets may be employed.

It has been appreciated that the composite material is ideally suited to the external walls of a multi-cellular structure as the polymeric grid layer provides the fabric layers with reinforcement and stiffness. It is therefore preferred that at least the external walls of the cells in a multi-cellular structure are formed of the composite material. In some embodiments the internal cell walls may be formed of a different material, typically a lighter and less rigid material, to reduce the overall weight of the structure and to make it easier for it to be flattened when not in use. This may be achieved where the cells are formed from separate wall panels and the panel forming an internal wall is chosen to be a different material. For example, the internal walls of the cells in a multi-cellular structure may be formed of a fabric material instead of the composite material. The fabric material may be a geotextile material, typically not reinforced.

In a set of embodiments the confinement structure comprises a plurality of interconnected cells and at least the external cell walls are formed of the composite material. The internal cell walls may also be formed of a composite material, or of another material such as a fabric material, as is described above. Advantageously the internal cell walls are not as high as the external cell walls. This allows the multi-cell confinement structures to be stacked on top of one another with the external cell walls of one structure nested inside the external cell walls of the other structure. The depth of the nesting is determined by the reduced height of the internal cell walls. This reduces the risk of escape of fill materials and improves the overall stability of the structure by providing a degree of interlock.

The materials used for the cell walls may be chosen depending on the application for which the structure is designed to be used. Although the fabric layer in the composite material (and the fabric material of any internal cell walls) may be formed of any suitable fabric material exhibiting strength and flexibility, including woven and knitted webs, it is preferably a nonwoven material. Such materials are often chosen for their flexibility, strength and durability. A nonwoven geotextile material may be used. The composite material may comprise more than one fabric layer laminated to the polymeric grid layer, on either side of the polymeric grid layer, or on both sides of the polymeric grid layer. The fabric material may be permeable or impermeable.

In one set of embodiments the composite material comprises a permeable fabric layer laminated to the polymeric grid layer. A permeable fabric material may be used so that fluids (liquid and/or vapour) can pass in and out of the cells. This can advantageously allow for liquid drainage in certain applications. Although any suitable lamination or bonding process can be used, flame lamination may be preferred as this technique can ensure that the permeability of the fabric layer is not reduced by the lamination process. Furthermore, a fabric layer comprising a geotextile material comprising bicomponent fibres may be preferred as bonding can be achieved by melting only the sheath of the fibres and without affecting the fibre cores.

In another set of embodiment the composite material comprises a liquid impermeable fabric layer laminated to the polymeric grid layer. A liquid impermeable fabric material may be used where it is desirable for the walls to be waterproof, for example when the confinement unit is to be used for flood defence barriers or the like. For example, the fabric layer may comprise a polyethylene-based microporous fabric material. A microporous fabric that is waterproof but breathable (i.e. vapour permeable) may be used for some applications. The liquid impermeable fabric layer may be laminated to one side of the polymeric grid layer with the other side left bare, or another liquid/fluid impermeable fabric layer laminated to the other side, or a liquid/fluid permeable fabric layer laminated to the other side. In order to make the cells entirely waterproof any joins or hinges between the wall panels may also have to be formed in a waterproof manner from suitable materials. Suitable hinge constructions are discussed in more detail below.

The polymeric grid layer of the composite material may be formed from any plastics material that can be moulded or extruded into mesh. Suitable plastics materials include polypropylene or high density polyethylene (HDPE). The grid openings can be e.g. round, square, triangular or rhombus-shaped, but the preferred grid configurations are square, rectangular or rhombus. A suitable polymeric grid might be a bi-axially orientated grid such as the SS geogrid produced by Tensar International, Cunningham Court, Shadsworth Business Park, Blackburn, BB1 2QX, or the polymeric grid may be in the form of a finer net or mesh of the type produced by Fiberweb Geosynthetics, Maldon, Essex (previously Terram Limited). However, the choice of polymeric grid may depend on the way in which the composite material is formed into walls for a cell, as will be discussed in more detail below.

It is an important feature of the invention that the polymeric grid layer is laminated to a fabric layer in the composite material forming at least the external cell walls. The composite material is preferably manufactured by thermally bonding the polymeric grid to the fabric layer, for example by means of a gas flame lamination process but a suitable adhesive lamination process could also be used. Lamination prevents the layers from separating and provides the walls with an integral construction. As is mentioned above, flame lamination may be preferred as this technique can allow for localised heating and prevent heat damage to the component layers. In one flame lamination method the polymeric grid layer may be heated primarily and the fabric layer then applied thereto so that bonding takes places across the grid structure without heat or pressure being applied elsewhere.

The cell(s) of the containment structure can be assembled in a number of different ways. However, conventional geocell manufacturing techniques may not be easily applied due to the rigidity imparted to the composite material by the polymeric grid. While multi-cellular structures formed solely of fabric materials are often formed from strips of material that are bonded (glued or stitched) together at intervals so as to be opened out into a honeycomb structure, it has been found that this technique cannot be readily applied to strips of the stiffer composite material. Instead, the cells may be formed from individual panels of the composite material or from strips that are hinged or hingedly connected to form the cell walls.

According to one set of embodiments the or each cell is formed from separate wall panels. The wall panels may be rigidly connected together to form a cell, but for ease of flat packing preferably the wall panels are pivotally interconnected at one or more corners of the or each cell. A hinge means may be provided where the edges of respective wall panels meet at a corner of a cell. It will be appreciated that a cell may have three, four or more corners depending on its shape e.g. triangular, rectangular, etc. The hinge means may be provided by any connection that allows one wall panel to pivot relative to the other, preferably enabling the panels to be folded face-to-face against one another when the empty structure is flattened for transportation.

In one set of embodiments the hinge means is preferably a mechanical hinge. The laminated structure of the composite material means that it is possible to attach a mechanical hinge mechanism to either or any of the layers of the composite material and any stresses generated will be distributed throughout the composite material. The hinge means may be provided by connecting pins, rods, cables, etc. or a spirally wound member. Such connectors could be metal but are preferably plastic so as to avoid any metal content in the structure. A metal hinge may be used but this is not preferred for the fragmentation risks discussed above.

A plastic hinge may be used and this has the advantage that it can be bonded or welded to the polymeric grid layer of the two interconnected wall panels. However, in preferred embodiments the hinge means comprises a hinged piece of flexible fabric material. The fabric material helps to keep down the weight of the structure and can make it easier to attach the hinged piece to the wall panels, whether to the polymeric grid layer or to the fabric layer. The hinged piece of flexible fabric material is preferably fixed to the wall panels e.g. by gluing or sewing.

The hinged piece of flexible fabric material can be fixed on either side of the wall panels formed of the composite material. Thus the hinged piece of flexible fabric material can be fixed to the fabric layer side or the polymeric grid layer side. In one set of embodiments the hinged piece of flexible fabric material is fastened to the polymeric grid layer side of the composite material. Preferably the hinged piece of flexible fabric material is arranged to overlap the outside of the polymeric grid layer of one or both wall panels. This can help to prevent the polymeric grid layer, which is typically more rigid, from delaminating from the fabric layer, which is typically more flexible, when the walls are strained. Furthermore, incorporating the polymeric grid in the assembly of the hinge mechanism in this way ensures that any load applied to the cell wall is fully absorbed by each component of the composite material.

In another set of embodiments the hinged piece of flexible fabric material is fastened to the fabric layer of the composite material. In these embodiments it may be preferred for the composite material to comprise an additional fabric layer so that the polymeric grid layer is laminated between two fabric layers in a sandwich construction. An additional hinged piece of flexible fabric material may then be attached to either or both of the fabric layers where two adjoining wall panels form a corner of a cell. In one preferred construction of a double hinge, an outer hinged piece of fabric is fastened across the outer fabric layers of the two adjoining panels and an inner hinged piece of fabric fastened across the inner fabric layers of the two adjoining panels. Such a hinge construction helps to reinforce the join between the wall panels and can provide a two-way hinge that allows the panels to bend either inwardly or outwardly. The hinged piece(s) of flexible fabric material may be attached by gluing or stitching to the fabric layer(s) of the composite material.

Each hinged piece of flexible fabric material may be formed from the same material as the fabric layer of the composite material forming the wall panels, or it may be a different material. The hinged piece of flexible fabric material is preferably formed from a high strength geotextile material such as a nonwoven fabric of a thermally bonded or mechanically bonded type, or a woven fabric. Where it is desired for the cells to be waterproof the hinged piece may be formed of a liquid impermeable fabric material. The hinged piece could be affixed to walls made of a composite material that also comprises a liquid impermeable fabric layer.

According to another set of embodiments the wall panels of the or each cell are formed from a strip of the composite material. The strip of composite material needs to be able to bend to form the corners of the cell, but this may not be easily achieved e.g. depending on the rigidity of the composite material imparted by the polymeric grid layer. It is therefore preferred that some of the corners of the or each cell are formed by a hinge integral to the composite material.

This feature is considered novel and inventive in its own right, and thus when viewed from a further aspect the present invention provides a confinement structure comprising one or more open cells for confinement, in use, of particulate fill materials such as soil, sand or aggregate, the or each cell comprising wall panels formed from a strip of rigid polymeric material with one or more hinges integrally formed in the strip to enable the material to bend at corner(s) between the wall panels. This solution may find use in confinement structures wherein the cell walls are formed entirely from a polymeric material. But in preferred embodiments the polymeric material is a composite material comprising a polymeric grid layer laminated to a fabric layer, as is described above.

One way to achieve an integral hinge could be to form a strip of the composite material with the polymeric grid layer spaced at intervals so that the fabric layer, preferably a flexible fabric material, is exposed in the gaps to provide a natural hinge between the spaced grid layers. The spacing of the grid layers may be chosen to match the width of the wall panels. However this construction could be more likely to suffer from problems of delamination, and the strength and rigidity of the cells could be compromised.

A preferred way of providing the polymeric or composite material with an integral hinge is to form one or more living hinges in a strip of the polymeric or composite material. It will be understood that what is meant by a "living" hinge is a thinned or more flexible part of the polymeric or composite material that joins together two sections, allowing them to bend along the line of the hinge. While the composite material described above is usually too rigid to form a corner of the cell, as a result of the polymeric grid layer, along the living hinge it can be made flexible enough to bend. The living hinge(s) may be formed by deforming the composite material, in particular the polymeric grid layer, under pressure. The localised extrusion caused by the application of pressure can form a thinned line that provides the hinge pivot point or living hinge.

When forming a living hinge in a composite material comprising a polymeric grid layer laminated to a fabric layer, the Applicant has recognised that the material chosen for the polymeric grid layer can determine how easy it is for deformation to be achieved to provide a living hinge. A highly crystalline polymeric material is harder to form into a living hinge, e.g. requiring a higher pressure and/or temperature to achieve deformation. A polymeric grid that has been extruded to achieve alignment and hence tensile strength, for example a biaxial geogrid or TriAx geogrid from Tensar, is a strong material that can not easily be deformed to provide a living hinge. In a set of embodiments it is therefore preferable for the polymeric grid layer to comprise an amorphous polymer material. An amorphous polymer material, i.e. one without crystallinity resulting from alignment, can be deformed more easily e.g. at lower pressure and/or temperature to provide a living hinge. A suitable material for the polymeric grid layer is a geonet or mesh from Fiberweb Geosynthetics (previously Terram Limited). Furthermore a polymeric grid layer that has not been strengthened is likely to be cheaper to manufacture. It is possible to benefit from reduced costs in terms of the polymeric grid layer because in the composite material it is laminated to a fabric layer that can be chosen to provide strength for the cell wall(s). The main purpose of the polymeric grid layer is to provide some rigidity for the fabric layer rather than to provide strength.

According to another aspect of the present invention there is provided a method of manufacturing an open cell for a confinement structure for particulate fill materials, the method comprising: providing a strip of material comprising a polymeric component; applying pressure along one or more line between side edges of the strip of material to form one or more living hinges in the polymeric component; folding the strip at the living hinge(s) to bring end edges of the strip together; and connecting together the end edges of the strip to form a cell. The strip of material may comprise a composite material comprising a polymeric layer laminated to a fabric layer, as is described above. Preferably the polymeric layer is a polymeric grid. Further preferably the polymeric grid layer comprises a substantially amorphous polymeric material.

An advantage of forming a living hinge in the composite material, preferably in a manufacturing step subsequent to lamination of the composite material, is that the living hinge allows the hinge fold to be aligned in any direction, totally independent of the shape or strand direction of the polymeric grid. Accurate control of the living hinge manufacturing process can ensure that the composite material is not damaged during the formation of the hinge, which in turn means that properties of the fabric and polymeric grid layers are not compromised and can thus be fully exploited in the cellular structure. This also negates the requirement for additional strengthening or support at the hinge sites. A living hinge can be employed with any type of polymeric grid or net layer, although the manufacturing process may be simpler and cheaper if the polymeric grid or net layer comprises a substantially amorphous material. Furthermore, as mentioned above, the hinge pivot direction can be totally independent of the direction of the net strands.

Another advantage of forming one or more integral hinges in a strip of polymeric or composite material that forms a cell is that the hinges can be provided not only at the corners of the cell between wall panels but also at a point in a wall panel where it may be desired for the panel to be able to fold, for example when the structure is collapsed flat. The structure may provided with additional hinges to allow it to fold flat in the style of a concertina. Thus, in one set of embodiments, one or more wall panels are provided with an integral hinge between the corners of the cell. The integral hinge may be a living hinge as described above or formed in any other way.

Where the or each cell is formed from a strip of polymeric or composite material, the end edges of the strip may be connected in any suitable way. In some embodiments the two ends of a strip may be fixedly connected together, for example by gluing or sewing. Where this method is used it may be preferred for the two ends of a strip to be joined to form a wall panel rather than to form a corner between wall panels. When the ends are joined in a wall panel they can be overlapped without having to bend the strip. Furthermore the fixed connection will not interfere with the hinging that is preferably provided at the corners of the or each cell. In one set of embodiments the method further comprises manufacturing a confinement structure comprising a plurality of cells joined side-by-side, wherein the end edges of a strip forming a respective cell are fixedly connected by the facing wall of an adjacent cell. In such embodiments the cell wall adjacent to each join effectively bridges across the ends of the strip to make the connection. The ends of the strip may not even be joined together when an adjacent wall spans across them. The benefits of this method of construction for a multi-cell structure are two-fold, in that less material may be required to effect the connection and the assembly time may be reduced as the cells are closed at the same time as being joined side-by-side.

In another set of embodiments the end edges of a strip are pivotally connected to form a corner of a cell, so that the hinged connection helps the cell to be folded down flat. Any of the hinge means described above may be used to provide the pivotal connection. In one preferred construction of a confinement structure the or each cell is formed from a strip of the composite material with at least two living hinges formed in the strip to allow the strip to be bent into the shape of a closed cell, and a separate hinge means is provided to pivotally interconnect the two ends of the strip. The pivotal connection between the ends of the strip may form a corner of the cell or a hinge point within a wall panel. Accordingly there is achieved a closed cell unit that can be easily manufactured and folded down flat when not in use, e.g. for transportation. The number and spacing of the living hinges in the strip may be chosen to dictate the shape of the closed cell, for example triangular, rectangular, square, polygonal, etc.

Regardless of the method by which a cell is formed, whether from separate wall panels or from a strip, multiple cells can be joined together side-by-side to produce a cellular confinement structure. The cells may be arranged to form a single row or column, for example when the confinement structure is intended for use as a wall or barrier, or they may be arranged in a two-dimensional array when it is desired to cover a larger area. Once one layer of a cellular confinement structure has been filled with particulate material such as soil, sand or aggregate, another layer may be stacked on top and filled, optionally followed by subsequent layers until a structure having a desired height is achieved.

There will now be described some preferred features that are generally applicable to all aspects and embodiments of the invention discussed above, regardless of the particular combination of features seen in the confinement structure.

According to at least some embodiments, the cell(s) of the confinement structure may be provided with one or more skirt portion(s) extending from at least some of the wall panels. Preferably the external wall panels of a multi-cell confinement structure are provided with skirt portion(s). Such skirt portion(s) may extend between the cells in two vertically juxtaposed confinement structures, for example when stacked one on top of another to form a defensive wall or barrier. The skirt portion(s) can provide the combined benefits of preventing the escape of fill material from underneath the cell walls and strengthening the stacked system. The skirt portion(s) can also help with alignment of the cells when confinement structures are stacked together. The skirt portion(s) may extend downwardly or upwardly.

In one set of embodiments the skirt portion(s) may be formed by a separate piece of material fastened to the composite or polymeric material of the cell walls. The skirt portion(s) may be formed of a plastics material, but such rigid skirt portions are not preferred as they can not be folded down. Preferably the skirt portion(s) are formed of a flexible fabric material. A flexible fabric skirt portion can be folded laterally into a cell, for example after it has been filled, and thereby provide additional support for the fill material in a cell above. The weight of fill material sitting on the skirt portion(s) can help to stop vertical displacement of a confinement structure, thus aiding stability. This may be particularly helpful if the confinement structure is stacked on top of another and the skirt portion(s) are folded into the structure before filling. The fabric skirt portion(s) may be formed of a permeable or impermeable fabric material. If a water resistant confinement structure is desired then liquid impermeable fabric skirt portions can be folded down over the walls to keep them dry.

Skirt portion(s) formed of a flexible fabric material can be attached to the cell walls in any suitable manner, including rivets, staples or clips (less preferred), adhesive or stitching. Gluing or stitching the skirt portion(s) are preferred methods as they can provide a continuous bond between the materials.

In another set of embodiments the skirt portion(s) may be integrally formed by the composite or polymeric material of the cell walls. While the skirt portion(s) may be provided by a polymeric e.g. grid layer, it is preferred that the skirt portion(s) are more flexible than a plastics material and thus the skirt portion(s) are preferably provided by the fabric layer of the composite material that forms the cell walls. An advantage of the skirt portion(s) being integrated with the fabric layer of the cell walls is that they are less likely to become detached than separate skirt portion(s).

In various embodiments the skirt portion(s) may be provided by a skirting strip extending around the periphery of a or the cell, or around the external periphery of several cells in a multi-cell confinement structure. The skirting strip may be a separate strip that is attached to the peripheral cell walls or it may be integrally provided by the material of the cell walls. Where the cell walls are formed from a strip of material it will be appreciated that an integral hinge such as a living hinge may be formed in the skirting strip as well as in the strip forming the wall panels. This might help the skirting strip to be folded down into the internal space of the confinement structure.

In at least some embodiments the composite (or polymeric) material forming the cell walls may comprise a fire retardant additive or a fire retardant material. This can be beneficial when the cell or cellular confinement structure is to be used for defensive purposes and may need to resist explosions and/or fire damage. Where the cell walls are formed of a composite material comprising a polymeric grid layer laminated to a fabric layer, it may be preferable for a fire retardant additive to be incorporated into the polymeric grid layer (rather than the fabric layer) as this has been found to provide adequate protection for the composite material while minimising the amount of additive material required due to the open structure of the grid as compared to the continuous fabric layer. Suitable thermoplastic additives are available from A. Schulman Plastics BVBA, Pedro Colomalaan 25, B-2880 Bornem, Belgium and one preferred additive is POLYBATCH® PR 1049 DC, an additive that is compatible with a range of polymeric materials such as LDPE, LLDPE, MDPE or HDPE, PP block copolymer, PP homopolymer and PP random copolymer. Such an additive may therefore be incorporated into a polypropylene grid material.

While the confinement structures described above are ideally suited for use without a supporting framework, as the rigidity of a polymeric material or the polymeric grid layer in a composite material ensures that the cells are self-supporting and can stand in an open configuration without collapsing before being filled, the cells and methods described above for forming cells may find use in conjunction with existing gabion-type structures. In particular, the cells and methods described above may be used to repair or renovate cellular systems such as Hesco Concertainer® in which wire mesh cells are lined with a geotextile material that typically starts to form holes and come away from the cells due to wear and degradation after a certain amount of use. Such deterioration can be attributed to the fact that the geotextile liner is not integrated with the wire mesh of the cell walls but merely fixed e.g. stapled to hang against the inside of the cells so the geotextile material is then prone to damage. One solution to these problems could be to replace such a system entirely with a more durable cellular confinement structure in which the cell walls are formed of a composite material, as is described above. However, another solution for systems that are already in position could be to line the existing wire mesh cells with cells formed of walls panels or strips of a composite material that comprises a polymeric grid layer laminated to a fabric layer. Such a composite liner would be more hard-wearing than the original geotextile liner and could further reinforce the mesh system to make it stronger and more impact-resistant.

Such a renovation technique is considered novel and inventive in its own right and thus when viewed from a further aspect the present invention provides a method of repairing a cellular confinement structure comprising a plurality of open cells formed of wire mesh, the method comprising the steps of forming one or more cell liners from a composite material comprising a polymeric grid layer laminated to a fabric layer and fitting the cell liners into respective cells of the confinement structure. The invention also extends to a cellular confinement structure comprising a plurality of open cells formed of wire mesh, wherein the cells are lined with a composite material comprising a polymeric grid layer laminated to a fabric layer. The liners may be formed using any of the methods described above, including wall panels joined by hinge means and strips with integral hinges. Once the cell liners have been fitted they may be attached to the wire mesh walls of the cells and/or to adjoining cell liners as desired.

BRIEF DESCRIPTION OF THE DRAWINGS

Some preferred embodiments of the present invention will now be described, by way of example only, and with reference to the accompanying drawings, in which.

DETAILED DESCRIPTION

Figure 1:
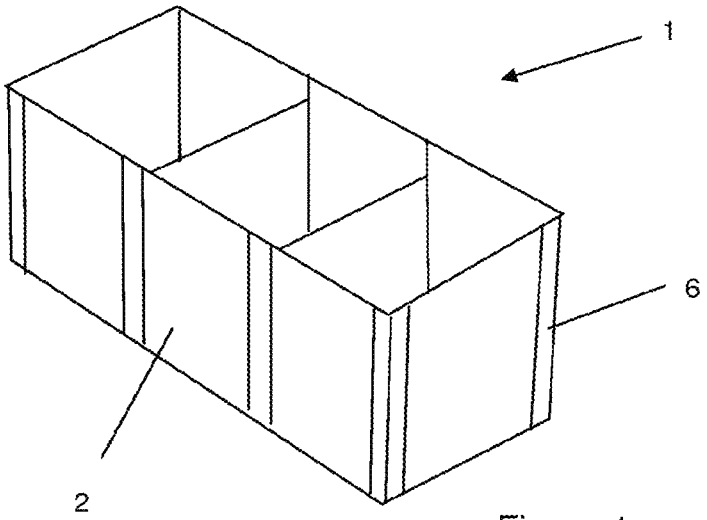
FIG. 1 is a perspective view of a multi-cell confinement structure.

There is seen in FIG. 1 a highly portable cellular confinement system 1 that when filled with a suitable aggregate or particulate fill can provide an effective asset protection structure for use in both the military and civil defence environments. The system is also likely to be well suited to flood defence applications.

At least the external cell walls 2 of the confinement system are manufactured from a plastic composite material consisting of a polymeric grid or mesh layer and either one or two geotextile layers. The layers are laminated together. A suitable grid might be of the SS bi-axially orientated type such as that produced by Tensar International, Cunningham Court, Shadsworth Business Park, Blackburn, BB1 2QX, and a suitable net or mesh might be of the type produced by Fiberweb Geosynthetics, Maldon, Essex (previously Terram Limited). The polymeric grid or mesh might be manufactured with round, square, triangular or rhombus shaped openings but the preferred configurations would be square, rectangular or rhombus. The composite material is preferably manufactured by thermally bonding the polymeric grid or mesh layer to the geotextile layer(s) by means of a gas flame lamination process but a suitable adhesive lamination process could be used.

The multi-cell unit 1 is made by gluing or stitching the required number of single cells together. The inner dividers or joining walls 4 might consist of a single geotextile layer with no reinforcement. It is shown in FIG. 1 that the corners of the cells comprise a hinge means 6, which may be provided by a separate hinged piece of material or by an integrally formed hinge. The cells of the unit 1 can therefore be collapsed and then zigzag folded.

Figure 2A:
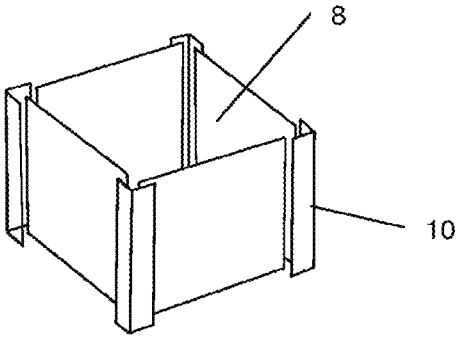
FIG. 2*a* is a schematic drawing of a cell construction according to a first embodiment and FIG. 2*b* is an exploded view of a multi-cell unit confinement structure formed from such a cell.
Figure 2B:
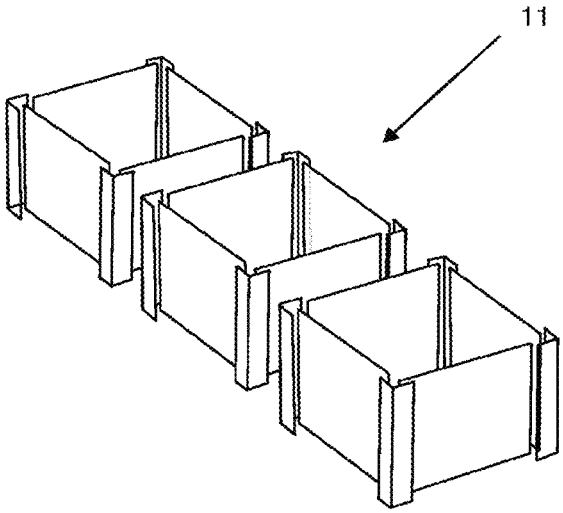

The cells can be assembled in a number of ways. Firstly, as seen in FIGS. 2*a* and 2*b*, cells can be formed from individual rectangular wall panels 8 joined by means of a fabricated hinge system. The hinges 10 provide the necessary flexibility to flat-pack the structure. FIG. 2*a* shows a single cell constructed from individual wall panels 8 joined at each corner by a fabricated flexible hinge 10—the hinge material can be attached by gluing or sewing. FIG. 2*b* shows a multi-cell unit 11 formed by joining together three of the single cells. In such a unit the inner walls will be made of a double layer of the composite material of the wall panels.

Alternatively, as seen in FIGS. 3 and 4, cells can be formed from strips of composite material. In these embodiments a strip of a length equivalent to the circumference of a single cell can be modified so as to contain a sufficient number of "living" hinges to allow the material to be folded to the desired shape and subsequently joined. For ease of formation of the living hinges, the composite material may be formed from a polymeric net layer that has not been aligned to provide tensile strength, such as a geonet or mesh from Fiberweb Geosynthetics (previously Terram Limited) rather than a biaxial geogrid or TriAx geogrid from Tensar.

Figure 3A:
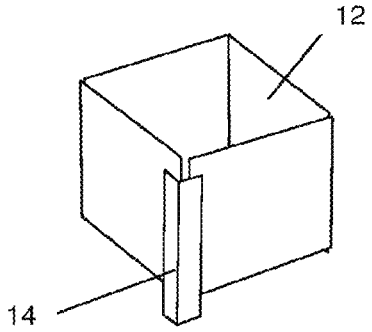
FIG. 3*a* is a schematic drawing of a cell construction according to a second embodiment and FIG. 3*b* is an exploded view of a multi-cell unit confinement structure formed from such a cell.
Figure 3B:
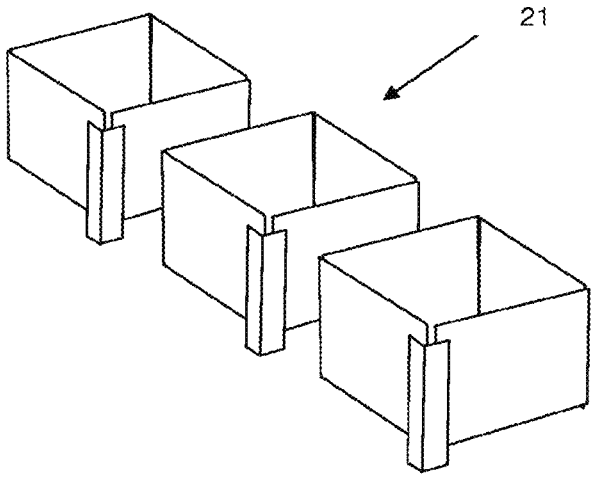

In FIG. 3*a* there is seen a cell formed from a strip 12 with three living hinges that create three of the corners and a single fabricated hinge 14 that creates the fourth corner. The hinge 14 may be provided by a separate piece of fabric material that connects the ends of the strip 12. FIG. 3*b* shows a multi-cell unit 21 formed by joining together three of the single cells. In such a unit the inner walls are again made of a double layer of the composite material. This embodiment requires less material than a cell construction that uses separate panels, as only one hinge piece is required. Moreover, manufacturing may be quicker and easier.

In both embodiments described with respect to FIGS. 2 and 3, the fully-bonded construction of the composite material enables the textile layer to be utilized as a fully load bearing component in the construction of the hinge(s).

Figure 4A:
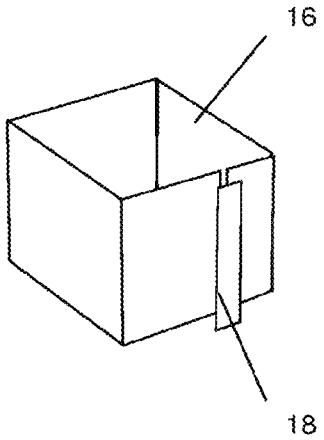
FIG. 4*a* is a schematic drawing of a cell construction according to a third embodiment and FIG. 4*b* is an exploded view of a multi-cell unit confinement structure formed from such a cell.
Figure 4B:
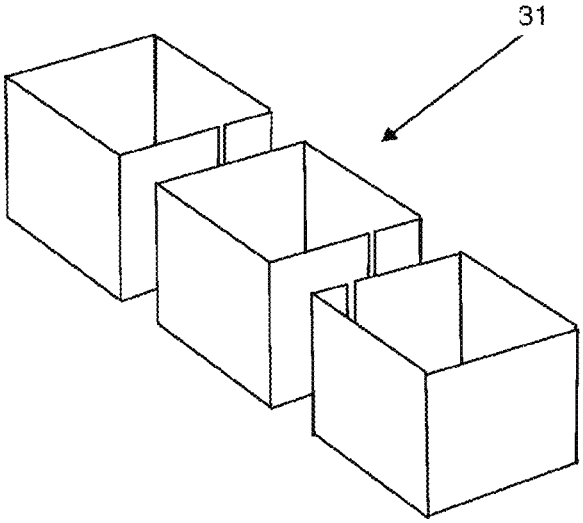

In FIG. 4*a* there is seen a cell formed from a strip 16 with four living hinges that create all four of the corners of the cell so that no separate hinge pieces are required. A separate piece of material 18 may be used to connect the ends of the strip 16. A cell so formed may then be attached side-by-side with another cell to form a multi-cell unit. However, to save material and reduce assembly time the cells can be joined together in a multi-cell unit 31 as seen in FIG. 4*b*, with the cell wall adjacent the join between the ends of the strip 16 bridging the ends to make the connection without requiring the separate connecting piece 18 seen in FIG. 4*a*. A double layer is therefore formed at the inner walls of the structure, with the joining position in one wall being offset from that of an adjacent wall so that the strip forming each cell is fixedly connected by the strip forming the facing wall.

Figure 5:
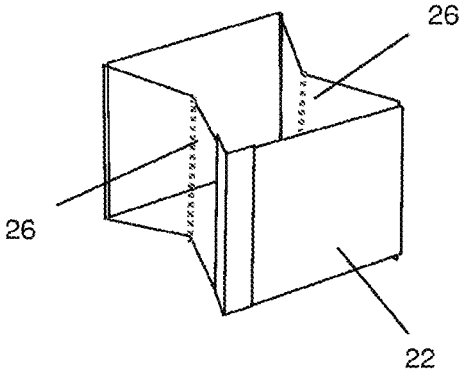
FIG. 5 shows additional hinge lines in the cell of FIGS. 3*a* and 3*b;*

FIG. 5 shows a single cell similar to that of FIG. 3*a* but with additional hinges 26 in two of the wall panels 22 which enable it to "concertina" fold. A multi-cell unit may consist of any practically transportable number of cells and more hinge assemblies might be incorporated into each cell to aid folding and thus improve the packing density of the product.

There are a number of possible methods of manufacturing a hinge mechanism in cells formed of a composite or polymeric material.

Figure 6A:
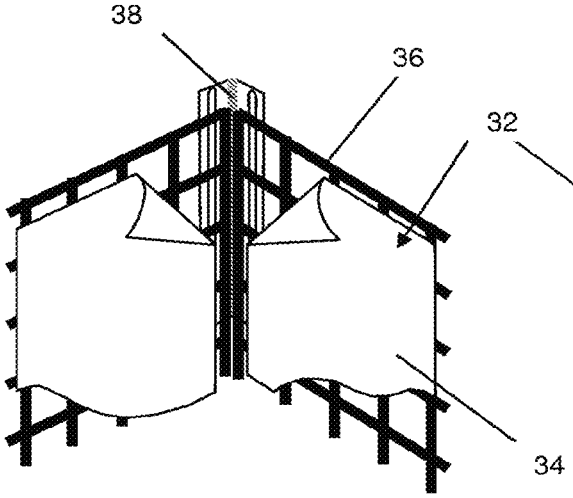
FIG. 6*a* is an exploded view of a first exemplary hinge construction.
Figure 6B:
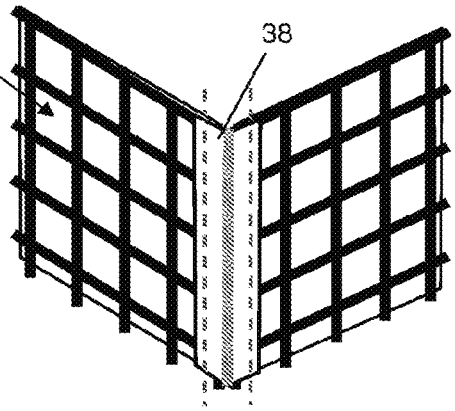
FIG. 6*b* shows the assembled hinge.

A first hinge construction is shown in FIGS. 6*a* and 6*b* for pivotal connection of two wall panels 32 formed of a composite material comprising a fabric layer 34 laminated to a polymeric grid layer 36. The hinge material 38 (e.g. a high strength geotextile fabric of a thermally bonded, mechanically bonded, or woven type) is attached to the composite wall panels 32, e.g. by means of a high strength adhesive or sewn, in such a manner that the hinged piece of material 38 always envelops at least one vertical member of the reinforcement grid in the polymeric layer 36. The gluing/stitching lines are highlighted in FIG. 6*b*. Incorporating the reinforcement grid layer 36 in the assembly of the hinge mechanism in this way ensures that any load applied to the cell walls 32 is fully absorbed by each component of the wall composite. The overlapping hinge piece 38 may also help to prevent delamination of the polymeric grid layer from the fabric layer 34.

Figure 7A:
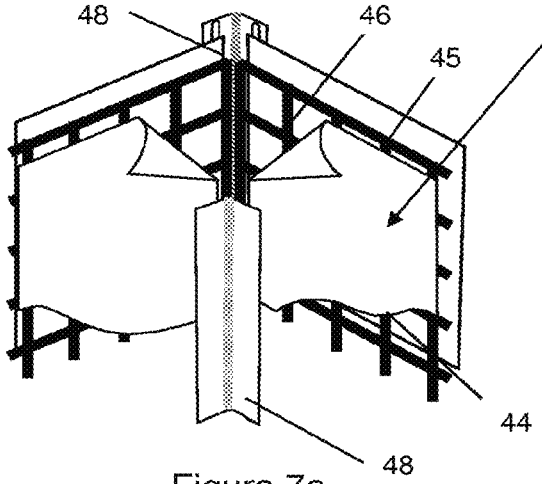
FIG. 7*a* is an internal exploded view of a second exemplary hinge construction and FIG. 7*b* is an external exploded view of the hinge construction.
Figure 7B:
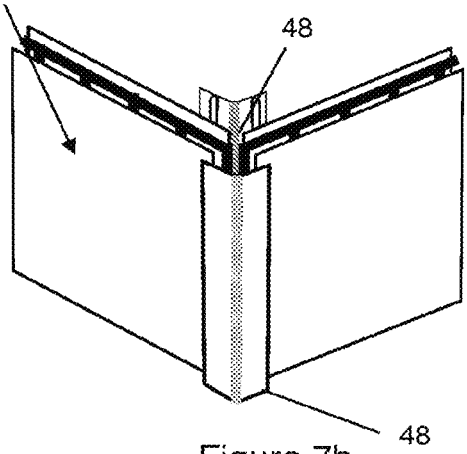

A second hinge construction requires that a three layered composite material is used to construct the cell walls 42, as is shown in FIGS. 7*a* and 7*b*. A polymeric grid layer 46 is laminated between a first fabric layer 44 and a second fabric layer 45. In this case a piece of hinge material 48 is attached by gluing or stitching to both the inner and outer fabric layers 44, 45 of the composite forming the wall panels 42. The result is a reinforced hinge and wall construction that ensures full integration with the stiff polymeric grid layer 46. This hinge construction also provides the flexibility of being able to fold the wall panels 32 either inwardly or outwardly.

Figure 8:
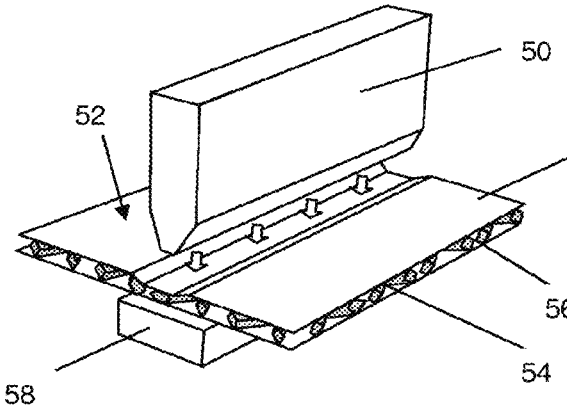
FIG. 8 shows a first method of producing a living hinge.
Figure 9:
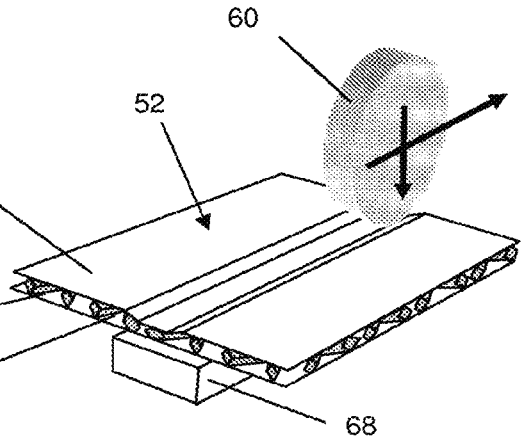
FIG. 9 shows a second method of producing a living hinge.

A third hinge construction does not use a separate hinge but instead requires that the composite material is pressed or deformed to cause localised extrusion of the polymeric grid material at the hinge pivot point, thus producing a form of "living" hinge. In FIG. 8 a high pressure (e.g. hardened steel) platen 50 acting against an anvil 58 is shown to form a living hinge in a panel 52 of composite material. In FIG. 9 a hardened steel wheel 60 is shown acting against an anvil 68 to form a living hinge in the panel 52 of composite material. The composite material of the panel 52 is seen to comprise a polymeric grid layer 56 sandwiched between a first fabric layer 54 and a second fabric layer 55, but the composite material may comprise a fabric layer on only one side of the reinforcement grid. The same technique may be used to form a living hinge in any polymeric material.

Figure 10:
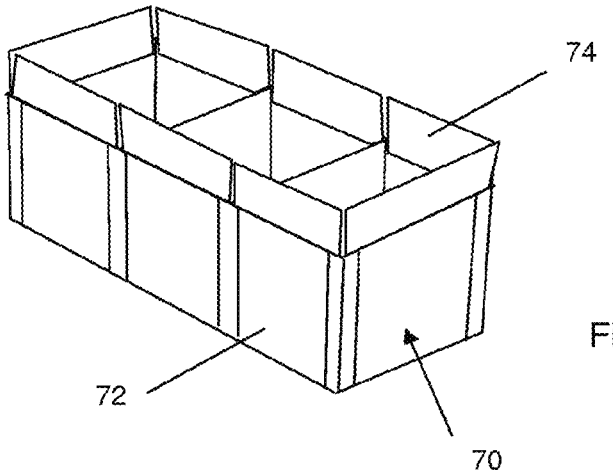
FIG. 10 perspective view of a multi-cell confinement structure comprising skirt portions.
Figure 11:
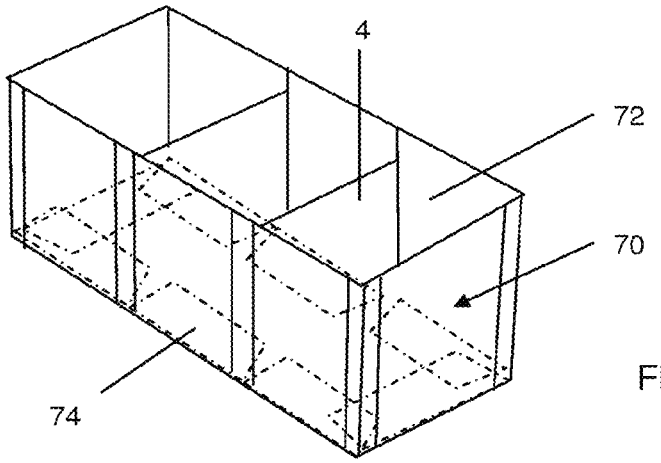
FIG. 11 shows the confinement structure of FIG. 10 with the skirt portions folded into the cells.

To ensure total containment of the fill material and improve the stability of the structure during filling, each cell 70 may be fitted with a fabric "skirt" 74 as shown in FIGS. 10 and 11. The skirt 74 is manufactured from a lightweight geotextile fabric which is adhered or sewn to the inside lower edge of the external walls 72 of each cell compartment. Typically the fabric of the skirt 74 protrudes 100 to 150 mm below the edge of the cell wall 72 and can be folded into the cell prior to filling, as is seen from FIG. 11. In FIG. 11 the dotted lines show the containment skirts 74 folded into the cells 70 in the correct position for filling. The skirt 74 has the combined benefits of preventing the escape of fill material from underneath the cell walls 72 and the weight of fill material sitting on the skirt 74 can stop vertical displacement of the cell wall during the filling operation, thus aiding stability.

Single and multiple units may be stacked to increase the height of a structure. In the case of the multi-cell unit seen in FIGS. 1 and 11 the internal dividers 4 are preferably 20 to 50 mm lower than the external walls 2, 72 to enable each layer to be nested into the preceding layer thus further reducing the risk of the escape of fill material and improving the overall stability of the structure by providing a degree of interlock.

While the embodiments shown in the drawings have been described with respect to cell walls formed of a composite material, according to some aspects of the invention the cells may be formed from a rigid polymeric material, for example a strip of such material provided with living hinges.

The invention claimed is:

1. A confinement structure, comprising:

a first open cell configured for confinement of particulate fill materials, the first open cell comprises (i) a first plurality of separate external wall panels each comprising a composite material defined by a polymeric grid layer thermally laminated to a fabric layer, and (ii) a first plurality of mechanical hinges each comprising a hinged piece of flexible fabric material; wherein the first plurality of separate external wall panels are pivotally connected using the first plurality of mechanical hinges;

wherein the fabric layer of at least one external wall panel comprises bicomponent fibers having a sheath component and a core component, and wherein the sheath component is thermally bonded to the polymeric grid layer.

2. The confinement structure of claim 1, wherein the first plurality of mechanical hinges includes a first mechanical hinge bonded to a first polymeric grid layer of a first external wall panel and a second polymeric grid layer of a second external wall panel.

3. The confinement structure of claim 2, wherein the first mechanical hinge is adhesively glued or thermally bonded to the first polymeric grid layer and the second polymeric grid layer.

4. The confinement structure of claim 1, wherein the first plurality of mechanical hinges includes a first mechanical hinge bonded to a first fabric layer of a first external wall panel and a second fabric layer of a second external wall panel.

5. The confinement structure of claim 4, wherein the first mechanical hinge is adhesively glued, stitched, or thermally bonded to the first fabric layer and the second fabric layer.

6. The confinement structure of claim 1, wherein the first plurality of mechanical hinges comprise a geotextile material.

7. The confinement structure of claim 1, wherein the first plurality of mechanical hinges comprises a liquid impermeable fabric material.

8. The confinement structure of claim 1, wherein the composite material is vapor permeable.

9. The confinement structure of claim 1, wherein the fabric layer of at least one external wall panel comprises a microporous fabric material.

10. The confinement structure of claim 1, wherein the fabric layer of at least one external wall panel comprises a liquid impermeable and vapor permeable fabric.

11. The confinement structure of claim 1, further comprising a second open cell located adjacent to and interconnected with the first open cell.

12. The confinement structure of claim 11, wherein the second open cell comprises (i) a second plurality of separate external wall panels, and (ii) a second plurality of mechanical hinges; wherein the second plurality of separate external wall panels are pivotally connected using the second plurality of mechanical hinges.

13. The confinement structure of claim 12, wherein the first plurality of separate external wall panels includes a first external wall panel and the second plurality of separate external wall panels includes a second external wall panel; the first open cell and the second open cell being joined together to provide an inner wall defined by both of the first external wall of the first open cell and the second external wall of the second open cell.

14. The confinement structure of claim 11, wherein the first open cell, the second open cell, or both are provided with one or more skirt portions extending from at least one of the separate external wall panels.

15. The confinement structure of claim 14, wherein the one or more skirt portions are formed by a separate piece of material fastened to the composite material.

16. The confinement structure of claim 1, wherein the confinement structure comprises a first configuration comprising a flattened configuration wherein a first external wall panel and a second external wall panel are folded face-to-face against one another and a third external wall panel and a fourth external wall panel are folded face-to-face against one another.

* * * * *